US006196808B1

(12) United States Patent
Taguchi

(10) Patent No.: US 6,196,808 B1
(45) Date of Patent: Mar. 6, 2001

(54) VARIABLE DISPLACEMENT COMPRESSOR AND DISPLACEMENT CONTROL VALVE SYSTEM FOR USE THEREIN

(75) Inventor: Yukihiko Taguchi, Maebashi (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/348,466

(22) Filed: Jul. 7, 1999

(30) Foreign Application Priority Data

Jul. 7, 1998 (JP) ..... 10-191137

(51) Int. Cl.[7] ..... F04B 1/26
(52) U.S. Cl. ..... 417/222.2
(58) Field of Search ..... 417/222.2, 222.5, 417/270

(56) References Cited

U.S. PATENT DOCUMENTS

| | | | | |
|---|---|---|---|---|
| 4,037,993 | | 7/1977 | Roberts | 417/222 |
| 4,425,837 | | 1/1984 | Livesay | 92/71 |
| 4,480,964 | | 11/1984 | Skinner | 417/222 |
| 4,586,874 | | 5/1986 | Hiraga et al. | 417/222 |
| 4,606,705 | * | 8/1986 | Parekh | 417/222 |
| 4,664,604 | | 5/1987 | Terauchi | 417/222 |
| 4,685,866 | | 8/1987 | Takenaka et al. | 417/222 |
| 4,687,419 | | 8/1987 | Suzuki et al. | 417/222 |
| 4,688,997 | | 8/1987 | Suzuki et al. | 417/222 |
| 4,702,677 | | 10/1987 | Takenaka et al. | 417/222 |
| 4,723,891 | | 2/1988 | Takenaka et al. | 417/222 |
| 4,730,986 | | 3/1988 | Kayukawa et al. | 417/222 |
| 4,778,348 | | 10/1988 | Kikuchi et al. | 417/222 |
| 4,780,059 | | 10/1988 | Taguchi | 417/222 |
| 4,780,060 | | 10/1988 | Terauchi | 417/222 |
| 4,842,488 | | 6/1989 | Terauchi | 417/222 |
| 4,874,295 | | 10/1989 | Kobayashi et al. | 417/222 |
| 4,878,817 | | 11/1989 | Kikuchi et al. | 417/222 |
| 4,940,393 | | 7/1990 | Taguchi | 417/222 |
| 4,960,367 | | 10/1990 | Terauchi | 417/222 |
| 5,051,067 | | 9/1991 | Terauchi | 417/222 R |
| 5,080,561 | | 1/1992 | Taguchi | 417/222 |
| 5,092,741 | | 3/1992 | Taguchi | 417/222 |
| 5,094,589 | | 3/1992 | Terauchi et al. | 417/222 S |
| 5,286,172 | | 2/1994 | Taguchi | 417/222.2 |

FOREIGN PATENT DOCUMENTS

| | | |
|---|---|---|
| 0219283 | 10/1986 | (EP) . |
| 474549 | 11/1992 | (JP) . |

* cited by examiner

*Primary Examiner*—Timothy S. Thorpe
*Assistant Examiner*—William Rodriguez
(74) *Attorney, Agent, or Firm*—Baker Botts L.L.P.

(57) ABSTRACT

A variable displacement compressor contains a displacement control valve system for controlling a displacement of fluid for compression. The displacement control valve system comprises a pressure sensing means for sensing a pressure of a suction chamber (63) or a pressure of a crank chamber (23), a transmission rod (101) supported so as to be capable of passing through a valve casing with an end thereof being in contact with this pressure sensing means, a valve body (127) for opening/closing a communication path between a discharge chamber (65) and a crank chamber (23) in correspondence to extension or contraction of the pressure sensing means while the other end of the transmission rod (101) is in contact with the valve body (127), and a solenoid (123) for applying an electromagnetic force to this valve body (127). A valve shaft (131) of the valve body (127) is supported so as to be capable of passing through a stator (111) of the solenoid (123). The valve shaft (131) is protruded into a plunger chamber (117) of the solenoid (123). The plunger chamber (117) is made to communicate with the suction chamber (63).

16 Claims, 5 Drawing Sheets

VARIABLE DISPLACEMENT COMPRESSOR AND DISPLACEMENT CONTROL VALVE SYSTEM FOR USE THEREIN

BACKGROUND OF THE INVENTION

1. Field of the Invention

The present invention relates to a displacement control valve system provided in a variable displacement compressor for use in automobile air conditioner or the like.

2. Description of the Related Art

Conventionally, a variable displacement compressor has been used in a refrigerating circuit of automobile air conditioner. A displacement control valve system is provided in a rear housing so as to change the volume of cooling refrigerant for compressing this variable displacement compressor. The displacement control valve system includes a valve casing and a solenoid. The valve casing has a pressure sensing space at an end thereof and a valve chamber at the other end. The pressure sensing space is connected to a suction chamber. Inside the sensing space, a bellows portion is disposed inside thereof. A valve chamber communicates with a crank chamber and discharge chamber of the compressor, and a path for communicating therebetween is opened or closed by a valve member accommodated in the valve chamber. An extension/contraction of the bellows portion is converted to a movement for opening/closing the valve via a transmission rod. Further, a solenoid adjusts the opening of this valve member.

In this displacement control valve system, if a cooling load of a compressor increases, an electromagnetic force increases so as to act for reducing a valve travel or valve lift, that is a opening degree of the valve. When the valve travel is decreased, the amount of refrigerant flowing into the crank chamber is decreased. As a result, a pressure of the crank chamber is reduced so that an inclination of the swash plate (angle relative to a plane perpendicular to a driving shaft) increases.

On the other hand, when the cooling load of the compressor is small, the electromagnetic force decreases so as to act for increasing the opening of the valve. As a result, the amount of refrigerant flowing into the crank chamber increases, so that a pressure of the crank chamber increases thereby the inclination of the swash plate being reduced.

This method is called external control method, which enables to change the displacement freely according to an external signal.

In the conventional external control method variable displacement compressor, it has been proposed to enforce the compressor to be maintained at its minimum displacement by detecting vehicle accelerations to reduce power consumption of the compressor, thereby improving the vehicle acceleration performance.

In the conventional displacement control valve system, even if power supply to the solenoid is turned OFF, a force which is a pressure difference acting to close the valve body is left. For example, if a suction chamber pressure exceeds an upper limit for control, the bellows is contracted so that the valve is closed. As a result, no discharge gas is supplied to the crank chamber. Therefore, the displacement cannot be maintained at its minimum level.

Further, such a problem also exists that when a constant current is supplied to the electromagnetic coil of the solenoid, the suction chamber pressure is changed by a discharge chamber pressure thereby a stabilized control being damaged.

Therefore, although a sealing area of the valve body has to be small to reduce an influence of the discharge chamber pressure, the amount of discharge gas introduced to the crank chamber becomes short, so that the displacement control becomes unstable.

SUMMARY OF THE INVENTION

Accordingly, it is an object of the present invention to provide a displacement control valve system for a variable displacement compressor in which a suction chamber pressure control accuracy is improved and the displacement thereof can be enforced to be maintained at its minimum one.

It is another object of the present invention to provide a variable displacement compressor employing the displacement control valve system.

To achieve the above object, according to an aspect of the invention, there is provided a variable displacement compressor having a discharge chamber, a suction chamber, a crank chamber, and a displacement control valve system for controlling a piston stroke by adjusting a pressure in the crank chamber. The displacement control valve system comprises: a pressure sensing means which is extended/contracted by sensing a pressure in the suction chamber or a pressure in the crank chamber; a transmission rod supported so as to be capable of passing through a valve casing with an end thereof being in contact with the pressure sensing means; a valve body for opening/closing a communication path between a discharge chamber and a crank chamber in correspondence to an extension/contraction of the pressure sensing means while the other end of the rod is in contact therewith; and a magnetic field applying means for applying a force based on an electromagnetic force to the valve body. In the displacement compressor, a valve shaft of the valve body is supported so as to be capable of passing through the stator which is the magnetic field applying means and the valve shaft is protruded into a plunger chamber of the magnetic field applying means so that the plunger chamber is made to communicate with the suction chamber.

Further, according to another aspect of the present invention, there is provided a displacement control valve system for a variable displacement compressor having a discharge chamber, a suction chamber, and a crank chamber for controlling a piston stroke by adjusting a pressure in the crank chamber. The displacement control valve system comprises: a pressure sensing means which is extended/contracted by sensing a pressure in the suction chamber or a pressure in the crank chamber; a transmission rod supported so as to be capable of passing through a valve casing with an end thereof being in contact with the pressure sensing means; a valve body for opening/closing a communication path between a discharge chamber and a crank chamber in correspondence to an extension/contraction of the pressure sensing means while the other end of the rod is in contact therewith; and a magnetic field applying means for applying a force based on an electromagnetic force to the valve body. In the displacement control valve system, a valve shaft of the valve body is supported so as to be capable of passing through the stator which is the magnetic field applying means and the valve shaft is protruded into a plunger chamber of the magnetic field applying means so that the plunger chamber is made to communicate with the suction chamber.

DETAILED DESCRIPTION OF THE PREFERRED EMBODIMENTS

Prior to description of the preferred embodiment of the present invention, a variable displacement compressor employing a conventional displacement control valve system and its displacement control valve system will be described with reference to FIGS. 1–3.

Figure 1:
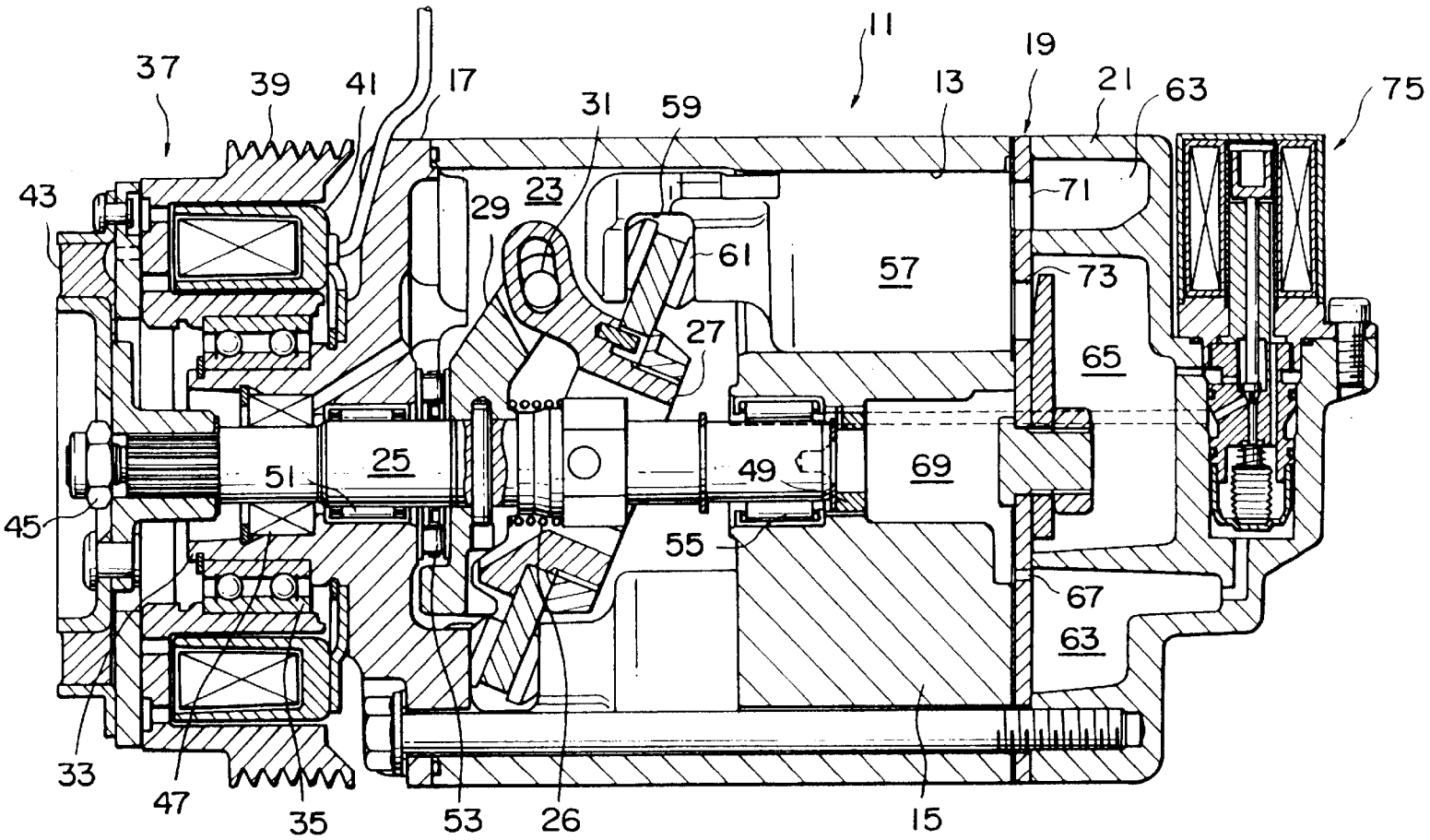
FIG. 1 PRIOR ART
FIG. 1 is a sectional view showing an entire structure of a variable displacement compressor employing a displacement control valve system of a prior art.

Referring to FIG. 1, a conventional variable displacement compressor 11 comprises a cylinder block 15 containing a plurality of cylinder bores 13, a front housing 17 provided on an end of the cylinder block 15 and a rear housing 21 provided on the cylinder block 15 through a valve plate 19. A driving shaft 25 is provided so as to pass through a crank chamber 23 defined by the cylinder block 15 and the front housing 17 and a swash plate 27 is disposed around a central portion of the driving shaft 25.

The swash plate 27 is joined to a rotor 29 fixed to the driving shaft 25 through a joint portion 31.

An end of the driving shaft 25 passes through a boss portion 33 protruded outside of the front housing 17 so as to extend outward. An electromagnetic clutch 37 is provided around the boss portion 33 via a bearing 35.

The electromagnetic clutch 37 comprises a rotor 39 provided around the boss portion 33, an electromagnetic unit 41 incorporated in the rotor 39 and a clutch plate 43 provided on an outside end face of the rotor 39. The end of the driving shaft 25 is joined to the clutch plate 43 via a fixing member 45 such as a bolt.

A sealing member 47 is interposed between the driving shaft 25 and the boss portion 33 to shut down communication between inside and outside. The other end of the driving shaft 25 is located inside the cylinder block 15 and supported by a supporting member 49. Reference numerals 51, 53 and 55 denote a bearing.

A piston 57 is disposed inside the cylinder bore 13. An outer periphery of the swash plate 27 is accommodated in a concavity 59 at an end of an inner portion of the piston 57. The piston 57 is inter-linked with the swash plate 27 through a shoe 61.

A suction chamber 63 and a discharge chamber 65 are defined in the rear housing 21. The suction chamber 63 is connected to the cylinder bore 13 via a suction valve (not shown) provided on a suction port 71 of the valve plate 19. On the other hand, the discharge chamber 65 is connected to the cylinder bore 13 through a discharge valve (not shown) provided on a discharge port 73 of the valve plate 19. The suction chamber 63 communicates with an air chamber 69 formed on an end of the driving shaft 25 through an opening 67.

A displacement control valve system 75 is provided in a concavity in a rear wall of the rear housing 21.

Figure 2:
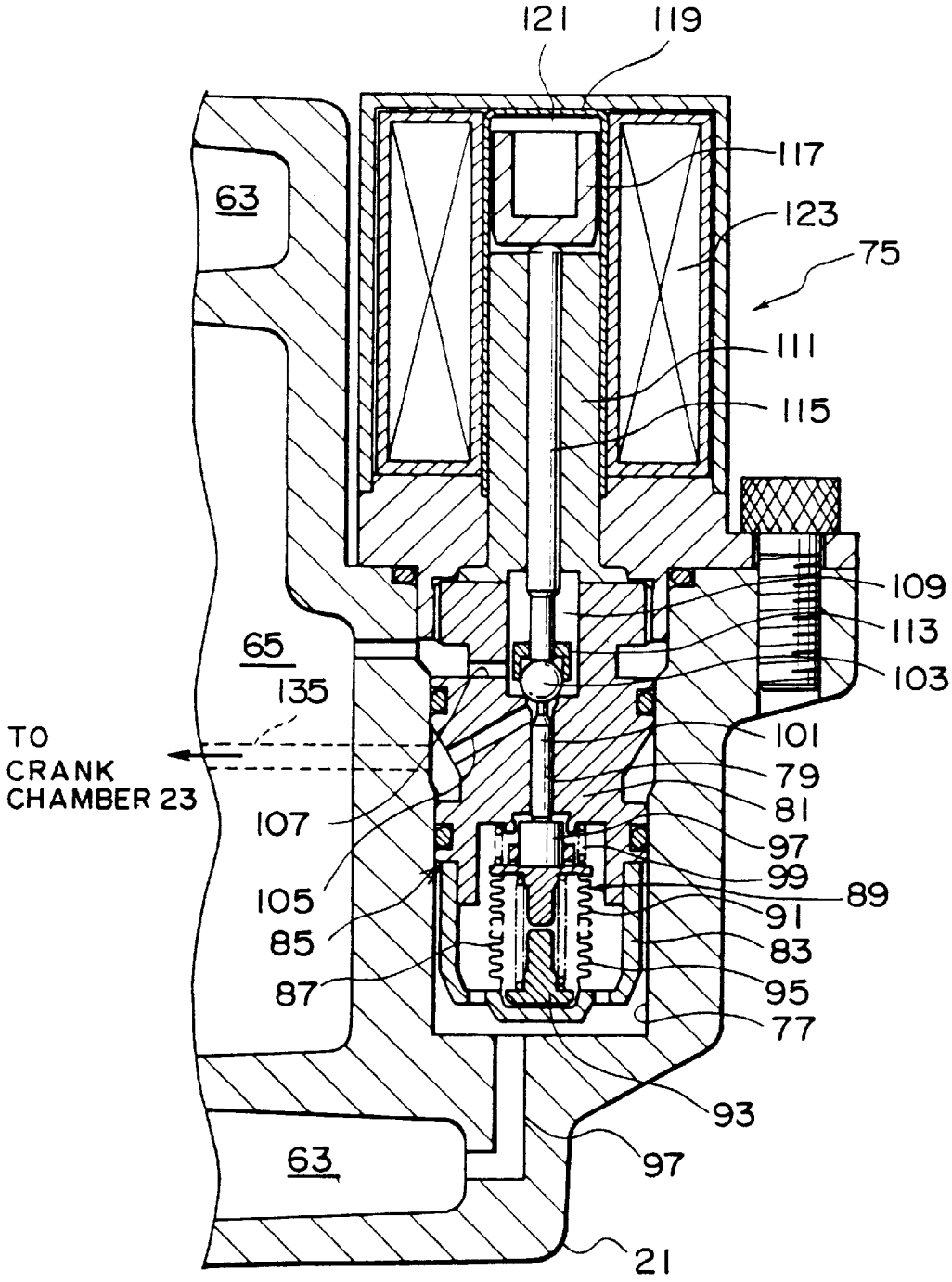
FIG. 2 PRIOR ART
FIG. 2 is a sectional view showing a displacement control valve system of the variable displacement compressor of the prior art.

Referring to FIG. 2, the displacement control valve system 75 is accommodated in an accommodating portion 77 provided on an end portion of the rear housing 21. The displacement control valve system 75 includes a valve casing 85. The valve 85 comprises a casing body 81 having a through hole 79 provided in the axial direction and a cap-shaped lid member 83 mounted on an end of the casing body. As a pressure sensing member, a bellows portion 89 is disposed in a pressure sensing space 87 formed by the lid member 83 together with a hollow made at an end of the casing body 81 of the valve casing 85. A pair of shaft members 93 are provided on both ends of a bellows body 91 so as to form a vacuum space inside the bellow body 91. An inner spring 95 is disposed between the shaft members 93 inside. The bellows portion 89 is disposed in a space which communicates with the suction chamber 63 through a communication path 97. Therefore, the bellows portion 89 is disposed in the pressure sensing space 87 and is so constructed to receive a pressure of the suction chamber 63. At an outside end of the bellows portion 89, a supporting member 97 is provided so as to be continuous from an end of the shaft member 93. Around the shaft member 93, a spring 99 is provided so as to press the bellows body 91 downward in the Figure.

A transmission rod 101 is supported in the through hole 79 provided in the valve casing 85 so that it is capable of passing therethrough. An end of the transmission rod 101 is in contact with the supporting member 97 of this bellows portion 89. The other end of this transmission rod 101 communicates with a concavity of the other end of the casing body 81 and a ball valve 103 is provided so that it is in contact with the other end of the transmission rod 101.

The ball valve 103 is moved in the axial direction by an extension and contraction of the bellows portion 89 so as to open and close a communication path 105 between the discharge chamber 65 communicating with an end of the through hole 79 and the crank chamber 23.

A valve chamber 109 communicates with the discharge chamber 65 through the communicating hole 107 and is formed at the other end portion of the casing body 81 in which the ball valve 103 is disposed. A stator 111 is provided on the other end (top end in the Figure) of the casing body 81 and a cup-like accommodating portion 113 is provided at an upper end of the ball valve 103 in the Figure so as to be in contact therewith. A solenoid rod 115 is supported by the stator 111 so that it is capable of passing therethrough. A plunger 117 is provided so as to be in contact with a top portion of the stator 111 in which the solenoid rod 115 is inserted. A tube 119 is provided so as to cover the top portion of the stator 111 and periphery of the plunger 117. A plunger chamber 121 is formed above the stator 111 inside the tube 119. A solenoid 123 is disposed as a magnetic field applying arrangement so as to surround the periphery of this tube 119. This solenoid 123 generates an electromagnetic force in a gap between the plunger 117 and the stator 111. The electromagnetic force is applied to the ball valve 103 through the solenoid rod 115.

Specifically, if a cooling load of the compressor increases at the time of cooling, an electromagnetic force increases thereby acting to reduce the opening of the ball valve 103. If the valve travel is reduced, the amount of refrigerant flowing into the crank chamber 23 decreases so that the pressure of the crank chamber 23 decreases and an inclination of the swash plate 27 (angle relative to a plane perpendicular to the driving shaft) increases.

On the other hand, if the cooling load of the compressor is small, the electromagnetic force decreases thereby acting to increase the opening of the ball valve 103. As a result, the amount of refrigerant flowing into the crank chamber 23 increases so that the pressure inside the crank chamber 23 increases, thereby the inclination of the swash plate 27 being reduced.

In the conventional displacement control valve system 75 having such a structure, a force Fv pressing the ball valve 103 in a direction in which it is closed and a force Fb acting on the bellows portion 89 and transmission rod 101 so as to press the ball valve 103 in a direction in which it is opened are expressed in the following formulas 1 and 2.

$$Fv=(Pd-Pc)\cdot Sv+f(I) \quad (1)$$

Pd: discharge chamber pressure, Pc: crank chamber pressure, Ps: suction chamber pressure, f(I): electromagnetic force at the time of current I, fs: spring's pressing force, fb: synthesized pressing force of bellows and internal spring, Sv: sealing area of ball valve, Sb: effective area of bellows portion, Sr: rod sectional area, $$Fb=fb-fs-\{(Sb-Sr)\cdot Ps+Sr\cdot Pc\} \quad (2)$$

Here, when Fv<Fb, the valve body constituted of the ball valve 103 is opened. From the formulas 1 and 2, a following formula 3 is established.

$$(Pd-Pc)\cdot Sv+f(I)<fb-fs-\{(Sb-Sr)\cdot Ps+Sr\cdot Pc\} \quad (3)$$

By substituting Ps+α for Pc in the formula 3 and rearranging, the following formula (4) is established.

$$Ps<-\frac{1}{Sb-Sv}\cdot f(I)-\frac{Sv}{Sb-Sv}\cdot Pd+\frac{fb-fs+(Sv-Sr)\cdot a}{Sb-Sv}$$

Figure 3:
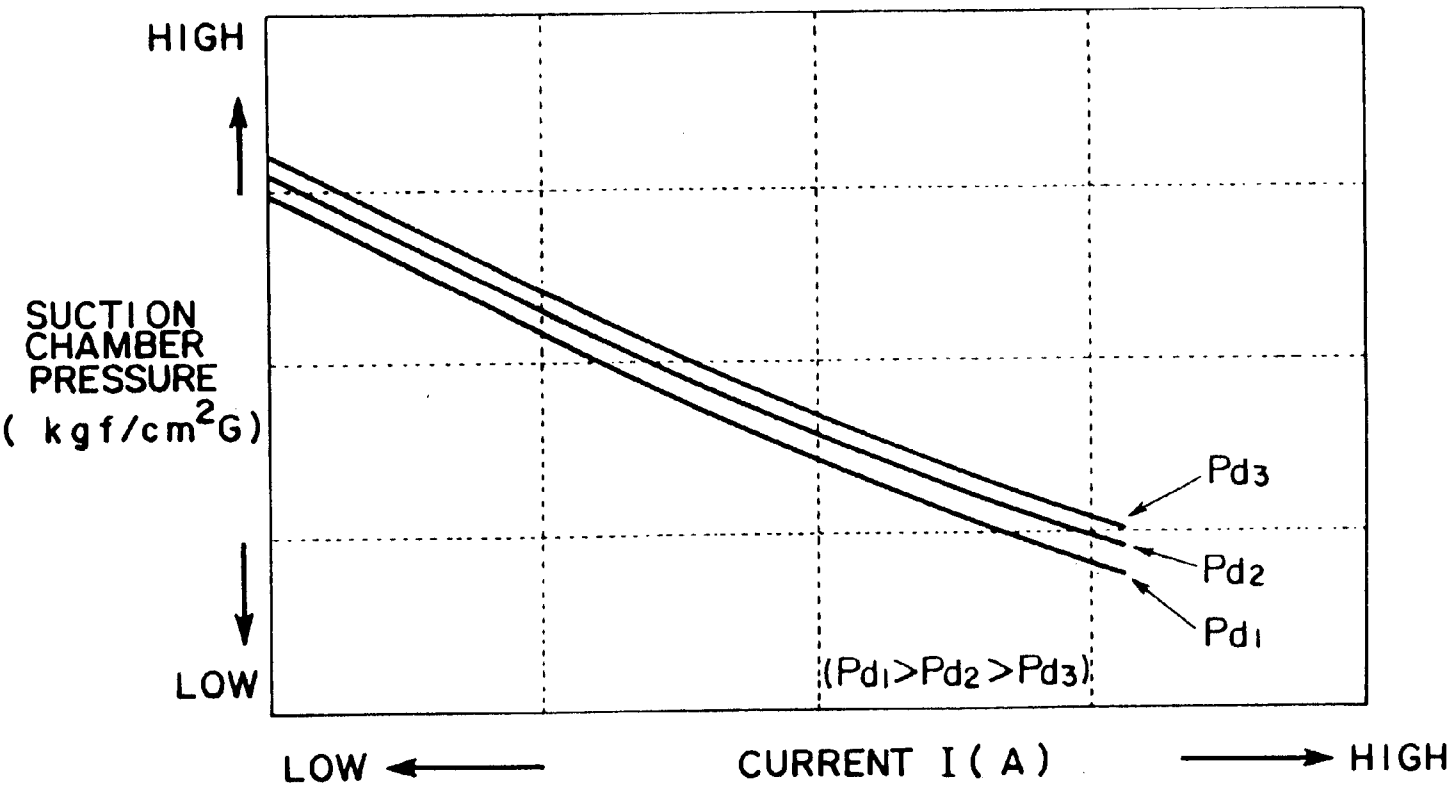
FIG. 3 is a diagram showing suction chamber pressure control characteristic of the displacement control valve system of the variable displacement compressor of the prior art.

The above formula 4 is a suction chamber pressure control characteristic of the displacement control valve system 75 and as shown in FIG. 3, by changing the amount of current supplied to the electromagnetic coil composed of the solenoid 123, the suction chamber pressure changes. The variable displacement compressor employing the displacement control valve having this structure is generally called external control type and its displacement can be changed freely by an external signal.

In the conventional external control type variable displacement compressor, it has been proposed to enforce the compressor to be maintained at its minimum displacement by detecting vehicle accelerations and reduce the consumption power of the compressor so as to improve the acceleration performance of the vehicle.

However, even if a supply of power to the solenoid 123 is turned OFF in the conventional displacement control valve system, Fv=(Pd−Pc)·Sv>0 is established from the above formula 1, so that a force which is a pressure difference trying to close the ball valve 103 is left. For example, if the suction chamber pressure exceeds an upper limit for control, the bellows is contracted so that from the above formula 2, Fb<0 is attained. Consequently, the valve body 103 is closed and no discharge gas is supplied to the crank chamber 23, so that the minimum displacement cannot be maintained.

As indicated by the above formula 4, even if a predetermined level of current is supplied to the electromagnetic coil 123, the pressure in the suction chamber 63 is changed due to the pressure of the discharge chamber 65, so that a stabilized control is damaged.

Therefore, although the sealing area of the ball valve 103 needs to be decreased to reduce an influence of the pressure of the discharge chamber 65, in this case, the introduction amount of discharge gas supplied to the crank chamber 23 becomes short thereby making the displacement control unstable.

Then, the embodiment of the present invention will be described with reference to FIGS. 4 and 5.

Because the compressor of the embodiment of the present invention has the same structure as the conventional compressor shown in FIG. 1 except the displacement control valve system, only the displacement control system will be described in this embodiment. In the displacement control valve system of the present invention, the similar parts are designated by like reference numerals as described in the conventional example with reference to FIGS. 1 to 3.

A first embodiment of the present invention will be described with reference to FIG. 4.

Figure 4:
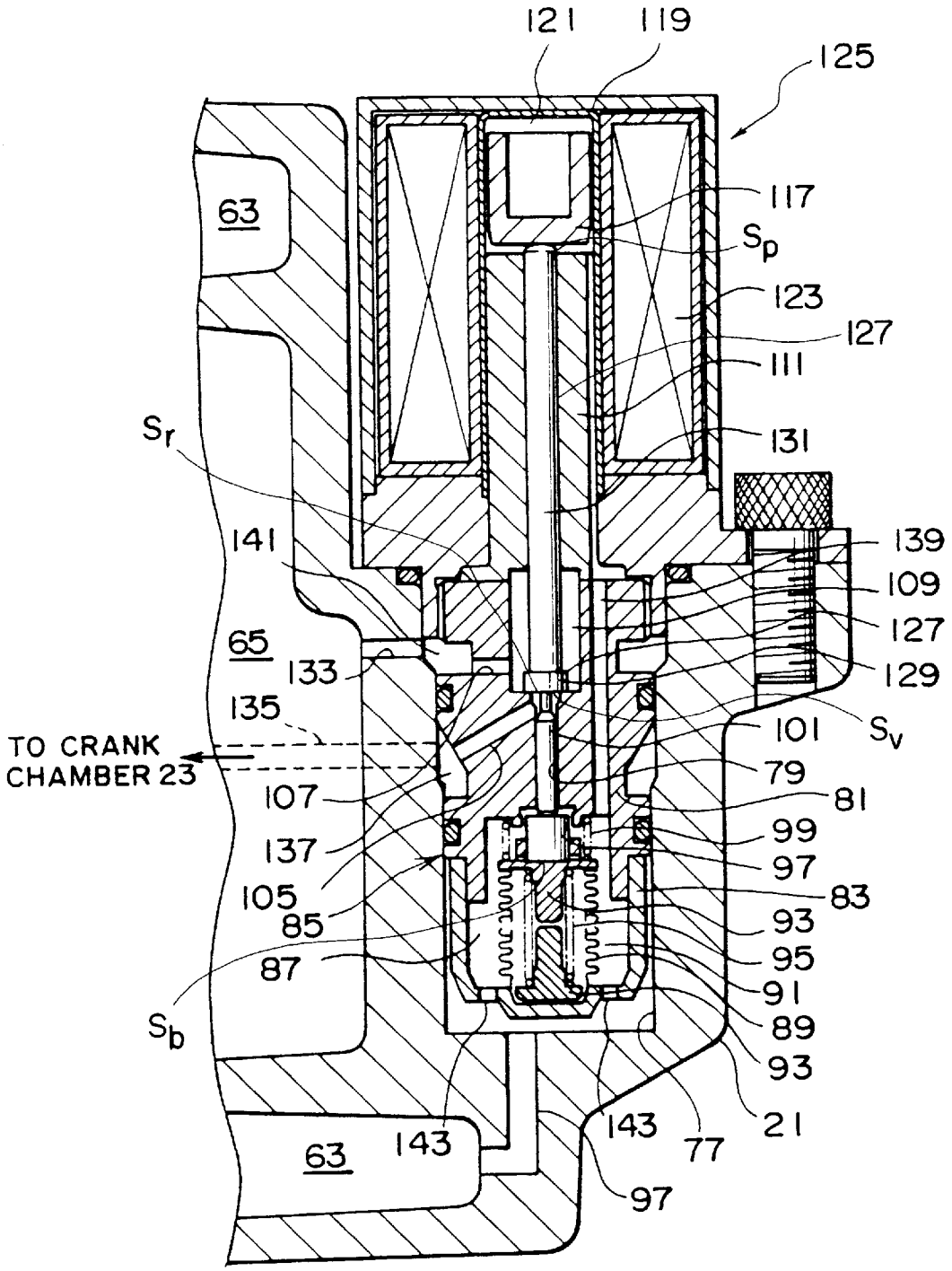
FIG. 4 is a sectional view showing a displacement control valve system of a variable displacement compressor according to a first embodiment of the present invention.
Figure 5:
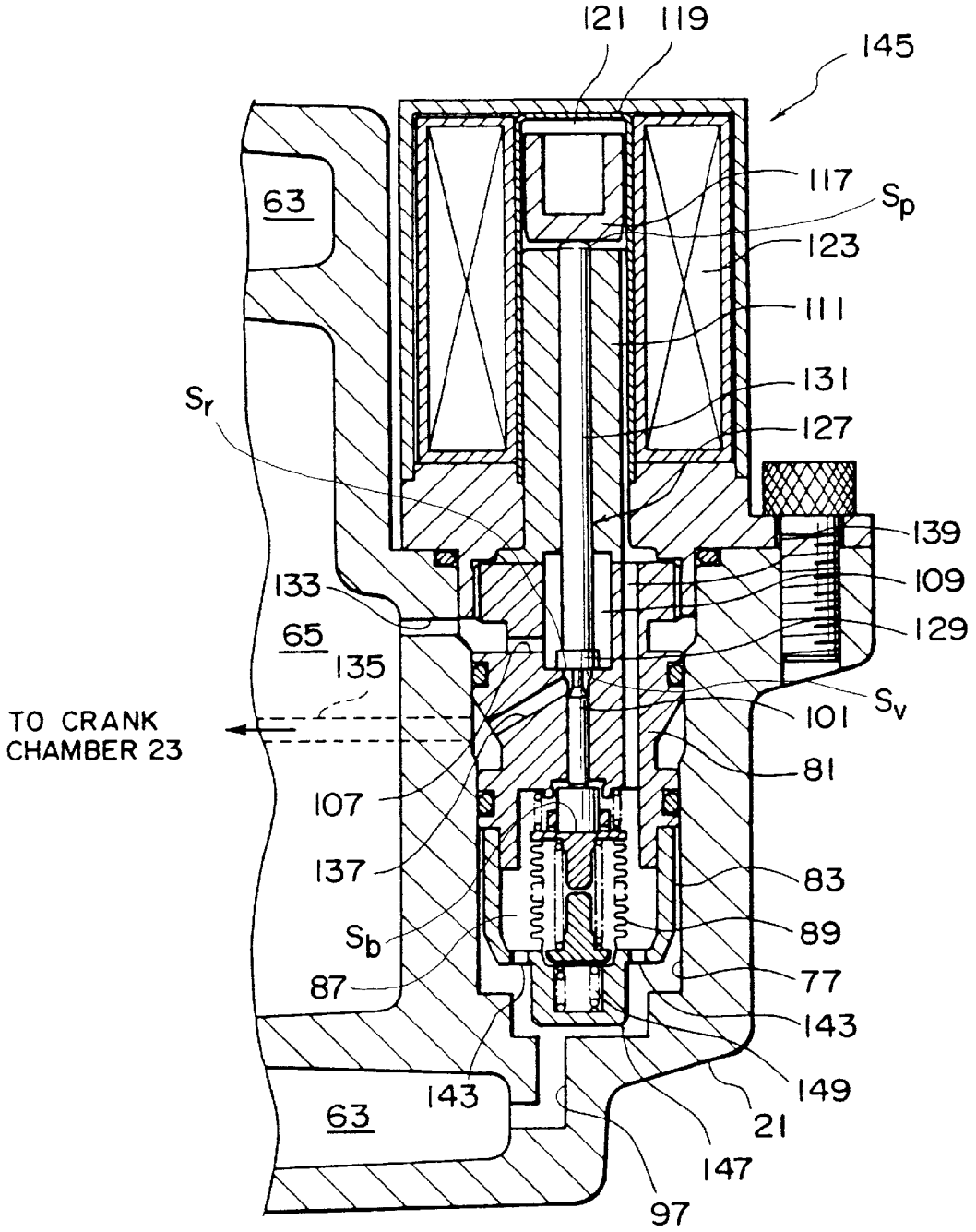
FIG. 5 is a sectional view showing a displacement control valve system of a variable displacement compressor according to a second embodiment of the present invention.

Referring to FIG. 4, a displacement control valve system 125 is provided in the accommodating portion 77 of the control system formed at an end of the rear housing 21 of the variable displacement compressor such that it is concave like the conventional art. The displacement control valve system 125 contains the valve casing 85 comprising the valve casing body 81 and the cap-shaped casing body 83 provided at an end thereof. The bellows portion 89 is disposed in the pressure sensing space 87 at an end of this valve casing 85.

The bellows portion 89 comprises the bellows body 91, shaft members 93, 93 the internal spring 95, the supporting member 97. The shaft members 93, 93 are disposed to protrude from both ends of the bellows body 91 inward thereof such that ends of the shaft members are apart from each other. The internal spring 95 is disposed around the periphery of the shaft members 93, 93 inside the bellows body 91. The supporting member 97 is provided at an end of the shaft member 93 of the bellows body 91 so as to be continuous with the shaft member 93. As a result, the inside of the bellows body 91 is vacuum. The spring 99 is disposed around the supporting member 97 so as to press the bellows body 91 downward in the Figure through the shaft member 93.

The bellows portion 89 acts as a pressure sensing means for receiving a pressure of the suction chamber 63 (hereinafter referred to as suction chamber pressure).

The casing body 81 contains the through hole 79 passing therethrough in the axial direction. This through hole 79 contains the transmission rod 101. The transmission rod 101 is supported so as to be capable of passing through the valve casing body 81. An end of the transmission rod is in contact with a top end of the supporting member 97 of the bellows portion 89. The other end of this transmission rod 101 is in contact with a large-diameter portion 129 at an end of a valve body 127. This valve body 127 opens and closes communication the paths 105, 107, and paths 133, 135 for communicating between the discharge chamber 65 and the crank chamber 23 in correspondence with an extension and contraction of the bellows portion 89. The stator 111 is disposed around the valve body 127. The stator 111 is in contact with a top end of the casing body 81 and supports a valve shaft 131 of the valve body 127 so as to be capable of passing through the stator 111. The valve chamber 109 is formed by the casing body 81 and an end portion of the stator 111. That is, an end of this valve body 125 is accommodated in the valve chamber 109.

The valve chamber 109 communicates through the discharge chamber 65, the path 133, a space 141, and the path 107. The plunger 117 is provided at the other end portion of the stator 111. The tube 119 is provided so as to cover this plunger 117 with the stator 111. The plunger chamber 121 is formed by the stator 111 and tube 119. A communication path 139 is provided to make this plunger chamber 121 communicate with the suction chamber 63, the path 97, a hole portion 143 and the pressure-sensing space 87.

The electromagnetic coil is disposed around the periphery of the tube 119. The electromagnetic coil is constituted of a solenoid 127 as a magnetic field applying arrangement for generating an electromagnetic force in a gap between the plunger 117 and stator 111, and applying that electromagnetic force to the large-diameter portion 129 of the valve body through the valve shaft 131.

In the displacement control valve system 125 having such a structure, a force Fv for pressing the valve body 127 in a direction for closing the valve and a force Fb which is applied to the bellows portion 89 and the transmission rod 101 to press the valve body 125 in a direction for closing the valve are expressed in the following formulas 5 and 6.

$$Fv=f(I)+Ps\cdot Sp-(Sp-Sv)\cdot Pd-Pc\cdot Sv \quad (5)$$

$$Fb=fb-fs-\{(Sb-Sr)\cdot Ps+Sr\cdot Pc\} \quad (6)$$

Pd: discharge chamber pressure, PC: crank chamber pressure, Ps: suction chamber pressure, fs: spring's pressing force, fb: synthesized pressing force of bellows and internal spring, f(I): electromagnetic force at the time of current I, Sv: valve body sealing area, Sb: effective area of bellows, Sr: transmission rod sectional area, Sp: pressure receiving area of valve shaft end Here, by substituting Ps+α for Pc, the following formulas 7 and 8 are established.

$$Fv=f(I)+(Sv-Sp)\cdot(Pd-Ps)-\alpha Sv \quad (7)$$

$$Fb=fb-fs-Sb\cdot Ps-\alpha\cdot Sr \quad (8)$$

Then, if the amount of supplied current (I) is zero from the solenoid 123 composed of the electromagnetic coil, electromagnetic force f(I)=0 and Fv=(Sv−Sp)·(Pd−Ps)−α·Sv. Because Pd−Ps>0 and α=Pc−Ps>0 and if Sv≦Sp is set up, Fv<0 is always established. That is, by making the suction chamber pressure receiving area (Sp) of the valve shaft 131 equal to or larger than the sealing area (Sv) of the valve body 127, even if a pressure of the suction chamber 63 exceeds an upper limit for control and consequently, the bellows portion 89 is contracted so that Fb<0 is established, by making the supplied current (I) to the electromagnetic coil 123 zero, Fv<0 is always established. As a result, the valve body 127 is always pressed up in the Figure by a force which is a pressure difference so that the valve is opened. Consequently, the discharge gas is always introduced into the crank chamber 23 so as to maintain a minimum displacement.

When Fv<Fb, the valve body is opened. The following formula 9 is established by the formulas 7 and 8.

$$f(I)+(Sv-Sp)\cdot(Pd-Ps)-\alpha\cdot Sv<fb-fs-Sb\cdot Ps-\alpha\cdot Sr$$

$$Ps<-\frac{1}{Sb+Sp-Sv}\cdot f(I)+\frac{Sp-Sv}{Sb+Sp-Sv}\cdot Pd+\frac{fb-fs+(Sv-Sr)\cdot a}{Sb+Sp-Sv}$$

The above formula 9 is suction pressure control characteristic of the displacement control valve system 125 of the first embodiment.

Therefore, by setting the suction chamber pressure receiving area (Sp) of the valve shaft 131 of the valve body 127 slightly larger than the valve body sealing area (Sv), the suction chamber pressure control characteristic is obtained which is hardly affected by a pressure of the discharge chamber (hereinafter referred to as discharge chamber pressure).

By setting Sv=Sp in the above formula 9, the suction chamber pressure control characteristic is obtained which is not affected by the discharge chamber pressure. Further, by setting up Sv=Sr, a suction chamber pressure control characteristic expressed by the formula 10 below, not affected by a pressure a or a pressure of the crank chamber 23 is obtained.

$$Ps<-\frac{1}{Sb}\cdot f(I)+\frac{fb-fs}{Sb} \quad (10)$$

Next, the displacement control valve system of the variable displacement compressor according to a second embodiment of the present invention will be described with reference to FIG. 5. According to a second embodiment of the present invention shown in FIG. 5, a displacement control valve system 145 for the variable displacement compressor is different from the displacement control valve system 125 of the first embodiment shown in FIG. 4 in that a spring 149 for pressing up the bellows portion 89 in a direction for opening the valve is disposed in a concave cup portion 147 at a bottom portion of the lid member 83 below the bellows portion 89 relative to the Figure. This spring 149 has a purpose for supporting the bellows portion 89 specifically when the bellows portion 89 is contracted like the conventional art. If the electromagnetic force f(I) becomes zero, it also has a function for pressing the bellows portion 89 entirely upward so as to open the valve body 127.

In the displacement control valve systems 125, 145 for the variable displacement compressor of the first and second embodiments, if the supplied current to the solenoid 123 is turned OFF, the valve body 127 is always open by a pressure difference acting on the valve body 127 in a direction for opening/closing it. As a result, the minimum displacement can be maintained and the control accuracy of the suction chamber pressure is improved.

Further, in a structure in which a spring is interposed between the bellows portion 89 and valve casing body 81, if the supplied current to the solenoid 123 is turned OFF, the valve body 127 is always open so that a minimum displacement can be maintained.

Although the variable displacement swash plate type compressor has been described as a variable displacement compressor of the embodiment of the present invention, the present invention is not restricted to the variable displacement swash plate type compressor, but it is needless to say that the present invention is applicable to a variable displacement swing plate type compressor.

As described above, according to the present invention, it is possible to provide a displacement control valve system for a variable displacement compressor capable of improving the suction chamber pressure control accuracy and maintaining the suction chamber pressure at a minimum displacement and a variable displacement compressor using the same.

What is claimed is:

1. A variable displacement compressor having a discharge chamber, a suction chamber, a crank chambers and a displacement control valve system for controlling a piston stroke by adjusting a pressure in said crank chamber, said displacement control valve system comprising:

a pressure sensing means which is extended or contracted by sensing a pressure in said suction chamber or a pressure in said crank chamber;

a transmission rod supported and adapted to pass through a valve casing with an end thereof being in contact with said pressure sensing means;

a valve body for opening a communication path between a discharge chamber and a crank chamber in correspondence to an extension of said pressure sensing means and for closing a communication path between a discharge chamber and a crank chamber in correspondence to a contraction of said pressure sensing means, while the other end of said rod is in contact therewith; and a magnetic field applying means for applying a force based on an electromagnetic force to said valve body, wherein a valve shaft of said valve body is supported and adapted to pass through a stator which is contained in said magnetic field applying means, said valve shaft protruding into a plunger chamber of said magnetic field applying means so that said plunger chamber is made to communicate with said suction chamber.

2. A variable displacement compressor according to claim 1, wherein said valve body has a first pressure receiving area for receiving a pressure in a plunger chamber of a valve shaft and a second pressure receiving area of a side of said body in contact with a valve seat for receiving a pressure from the crank chamber, said first pressure area being set equal to or larger than said second pressure receiving area.

3. A variable displacement compressor according to claim 1, wherein said transmission rod has a crank chamber pressure receiving area set equal to a second pressure receiving area of a side of said valve body in contact with a valve seat for receiving a pressure from a crank chamber.

4. A variable displacement compressor according to claim 1, wherein an elastic member is provided for pressing said pressure sensing means in a direction for opening the valve and is interposed between said pressure sensing means and said valve casing.

5. A variable displacement compressor according to claim 1, further comprising a communication path for making a pressure sensing chamber communicate with said plunger chamber, wherein said pressure sensing means is provided in said pressure sensing chamber communicating with said suction chamber.

6. A variable displacement compressor according to claim 5, wherein said valve body has a cylindrical shape.

7. A displacement control valve system for a variable displacement compressor having a discharge chamber, a suction chamber, and a crank chamber for controlling a piston stroke by adjusting a pressure in said crank chamber, said displacement control valve system comprising:

a pressure sensing means which is extended or contracted by sensing a pressure in said suction chamber or a pressure in said crank chamber;

a transmission rod supported and adapted to pass through a valve casing with an end thereof being in contact with said pressure sensing means;

a valve body for opening a communication path between a discharge chamber and a crank chamber in correspondence to an extension of said pressure sensing means and for closing a communication path between a discharge chamber and a crank chamber in correspondence to a contraction of said pressure sensing means, while the other end of said rod is in contact therewith; and a magnetic field applying means for applying a force based on an electromagnetic force to said valve body, wherein said valve body has a valve shaft supported and adapted to pass through a stator which is contained in said magnetic field applying means, said valve shaft protruding into a plunger chamber of said magnetic field applying means so that said plunger chamber is made to communicate with said suction chamber.

8. A displacement control valve system for a variable displacement compressor according to claim 7, wherein said valve body has a first pressure receiving area for receiving a pressure in a plunger chamber of a valve shaft of said valve body, and a second receiving area of a side of said valve body in contact with a valve seat for receiving a pressure from the crank chamber, said first pressure receiving area being set equal to or larger than the second pressure receiving area.

9. A displacement control valve system for a variable displacement compressor according to claim 7, wherein said transmission rod has a crank chamber pressure receiving area of said transmission rod set equal to a second pressure receiving area of a side of said valve body in contact with a valve seat for receiving a pressure from a crank chamber.

10. A displacement control valve system for a variable displacement compressor according to claim 7, wherein an elastic member is provided for pressing said pressure sensing means in a direction for opening the valve and is interposed between said pressure sensing means and said valve casing.

11. A displacement control valve system for a variable displacement compressor according to claim 7, further comprising a communication path for making a pressure sensing chamber communicate with said plunger chamber, wherein said pressure sensing means is provided in said pressure sensing chamber communicating with said suction chamber.

12. A displacement control valve system for a variable displacement compressor according to claim 11, wherein said valve body has a cylindrical shape.

13. A variable displacement compressor according to claim 2, wherein said first pressure receiving area is a suction chamber pressure receiving area and said second pressure receiving area is a sealing area.

14. A variable displacement compressor according to claim 3, wherein said crank chamber pressure receiving area is a transmission rod receiving area and said second pressure receiving area is a sealing area.

15. A displacement control valve system for a variable displacement compressor according to claim 8, wherein said first pressure receiving area is a suction chamber pressure receiving area and said second pressure receiving area is a sealing area.

16. A displacement control valve system for a variable displacement compressor according to claim 9, wherein said crank chamber pressure receiving area is a transmission rod receiving area and said second pressure receiving area is a sealing area.

* * * * *